United States Patent [19]

Carlson et al.

[11] 4,361,071

[45] Nov. 30, 1982

[54] FIRE CONTROL MECHANISM

[75] Inventors: Donald J. Carlson, Troy; Martin J. Neumeyer, Utica; Glenn O'Rourke, Lake Orion; Roger K. Waid, Rochester, all of Mich.

[73] Assignee: The United States of America as represented by the Secretary of the Army, Washington, D.C.

[21] Appl. No.: 189,980

[22] Filed: Sep. 22, 1980

[51] Int. Cl.[3] ..... F41F 3/04

[52] U.S. Cl. ..... 89/1.815; 244/3.12

[58] Field of Search ..... 89/1.802, 1.815, 1.816, 89/1.819, 37 H, 41 ME; 244/3.11, 3.12, 3.13, 3.14

[56] References Cited

U.S. PATENT DOCUMENTS 3,466,968 9/1969 Stangl et al. ..... 89/1.815

*Primary Examiner*—Stephen C. Bentley

*Attorney, Agent, or Firm*—Peter A. Taucher; John E. Becker; Nathan Edelberg

[57] ABSTRACT

A TOW (Tube-launched, Optically tracked, Wire-guided) missile system is mounted on a combat vehicle turret for greater combat effectiveness. Before the missile is launched, the gunner keeps the target in his sights in azimuth by powering the turret through a movable sight to which the turret is slaved by a lock mechanism. Missile launch energizes certain electrical devices which unlock the mechanism to make sight movement independent of the turret, open the turret drive motor power switch, and set a brake on the motor which locks the turret against movement to provide a stable platform for tracking the target during missile flight. After a preset time to allow for on-target impact, the devices are automatically reset and the turret drive is again slaved to the sight in azimuth.

10 Claims, 5 Drawing Figures

FIRE CONTROL MECHANISM

GOVERNMENT INTEREST

The invention described herein may be manufactured, used and licensed by or for the Government for governmental purposes without payment to us of any royalty thereon.

BACKGROUND AND SUMMARY OF PRIOR ART

The TOW (Tube-launched, Optically-tracked, Wire-guided) missile system which is tripod mounted on the ground, and an armored personnel carrier, which is self-propelled, are the prior art as far as the inventors are informed. The problem faced by the inventors in this case was to provide a TOW missile system with improved crew protection, so that missiles could be launched from a protected mobile platform (although stationary at the time of firing) when deployed for use in mobile combat, instead of relying on nothing more than a ballistic curtain to protect the crew.

Because crew protection was required, preferably without sacrificing TOW effectiveness, turret-mounted launch tubes were indicated to accomplish the objective in a cost-effective manner, and because turrets are too heavy for expeditious rotation by handpower, power machine drives or systems must of course be employed to accomplish azimuth traversing.

The aforementioned power system is conventionally disposed between the gunner-operator and the tracker which has the disadvantage of diminishing tracking response and hit probability. Even such a disadvantage is acceptable as a trade-off to obtain the advantage of powered means to control and move such a heavy mechanism.

In a device made according to this invention, once the missile is launched, movement of the launch tube has no effect on missile trajectory; during flight, the missile is subject to control by its on-board devices which are an integral part of the overall guidance system. The gunner controls the missile by movement of the optical sighting device through which the target is tracked and the missile is guided to the target. If the sighting device were connected physically with the turret after launch, there could be a degradation of TOW system tracking capability during the critical period of missile flight.

Accordingly, once the missile has left the launch tube, the sight which tracks the target should be free from such encumbrances by disconnection of the azimuth movement of the sight from turret rotation. In such a system, the TOW sight is coupled to the turret as long as the missile is in the launch tube. Thereafter, during flight guidance of the missile, the TOW sight is independent of turret position because firing of the launch mechanism puts in motion a sequence of events to disconnect, mechanically, the turret from the sight device movement and to set a brake which prevents accidental further rotation of the turret.

SUMMARY OF THE INVENTION

The invention comprises lock means providing an interface with the sight and the turret such that, in the coupled condition of the lock means, the sight is not movable in azimuth apart from turret rotation. Upon firing of the missile launch mechanism, a sequence is triggered which uncouples the sight and the turret and allows the gunner freedom for manual sight orientation in azimuth on a stable platform, namely the turret which is braked into and held in a stationary position.

OBJECTS

An object of the invention is to provide a TOW/vehicle interface mechanism such that a TOW weapon system can be mounted in and operated from a combat vehicle affording improved crew protection without degrading the inherent TOW system effectiveness.

The above and other objects are realized in a mechanism comprising a vehicle-mounted turret rotatable about a substantially vertical axis, a missile launch tube mounted on the turret and movable in azimuth by rotation of the turret, a power source to rotate the turret, an optical sighting device mounted on the turret for rotation about a second vertical axis, lock means to secure the sighting device against such rotation about the second vertical axis wherein the lock means includes a force transducer responsive to torque applied to rotate the sighting device about the second vertical axis in efforts to track a target, means to supply power to the power source in response to signals from the transducer and including a means to shut off the power flow and brake the turret, means to fire a missile to cause the missile to leave the launch tube on a trajectory directing the missile toward a target, and means, actuable by the firing means, to operate the power flow shut-off means and for uncoupling the lock means so that the sighting device is free to rotate about the second axis.

IN THE DRAWINGS

GENERAL DESCRIPTION

Figure 1:
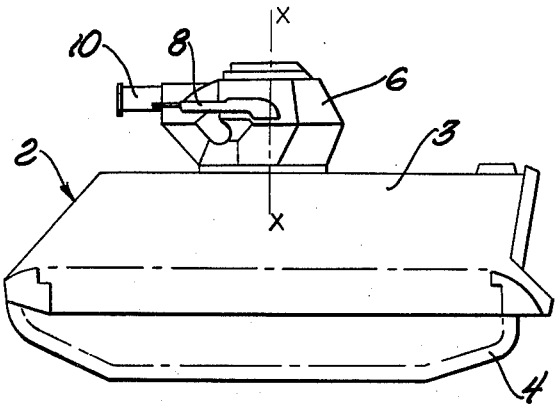
FIG. 1 is a side elevation view of a personnel carrier equipped with at turret and TOW missile launching mechanism embodying this invention.

FIG. 1 shows a combat vehicle 2, armored. Characteristically, such vehicles are structurally exoskeletal, having a hull 3 of armor plate; the hull is the vehicle's basic supporting structure. The vehicle has a track 4 and a turret 6 mounted for 360° traverse. As here shown, turret 6 carries a machine gun 8 and missile launch tubes, one of which is shown schematically (FIGS. 1 and 2) at 10, and in top plan in FIG. 3.

Figure 2:
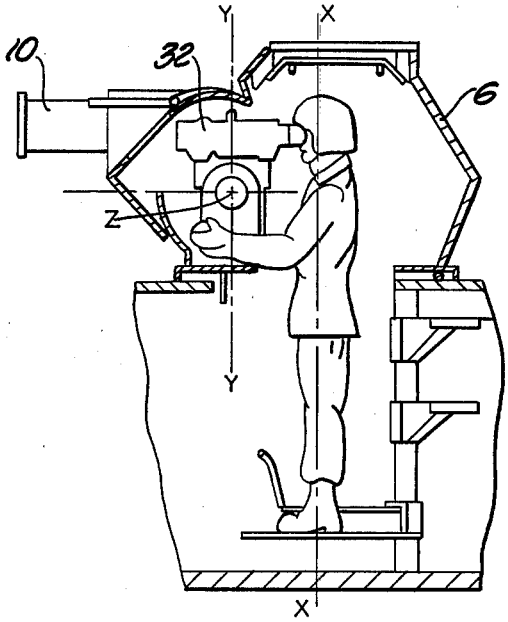
FIG. 2 is a view in section through the turret showing a gunner in the standing position and operating the sighting mechanism.
Figure 3:
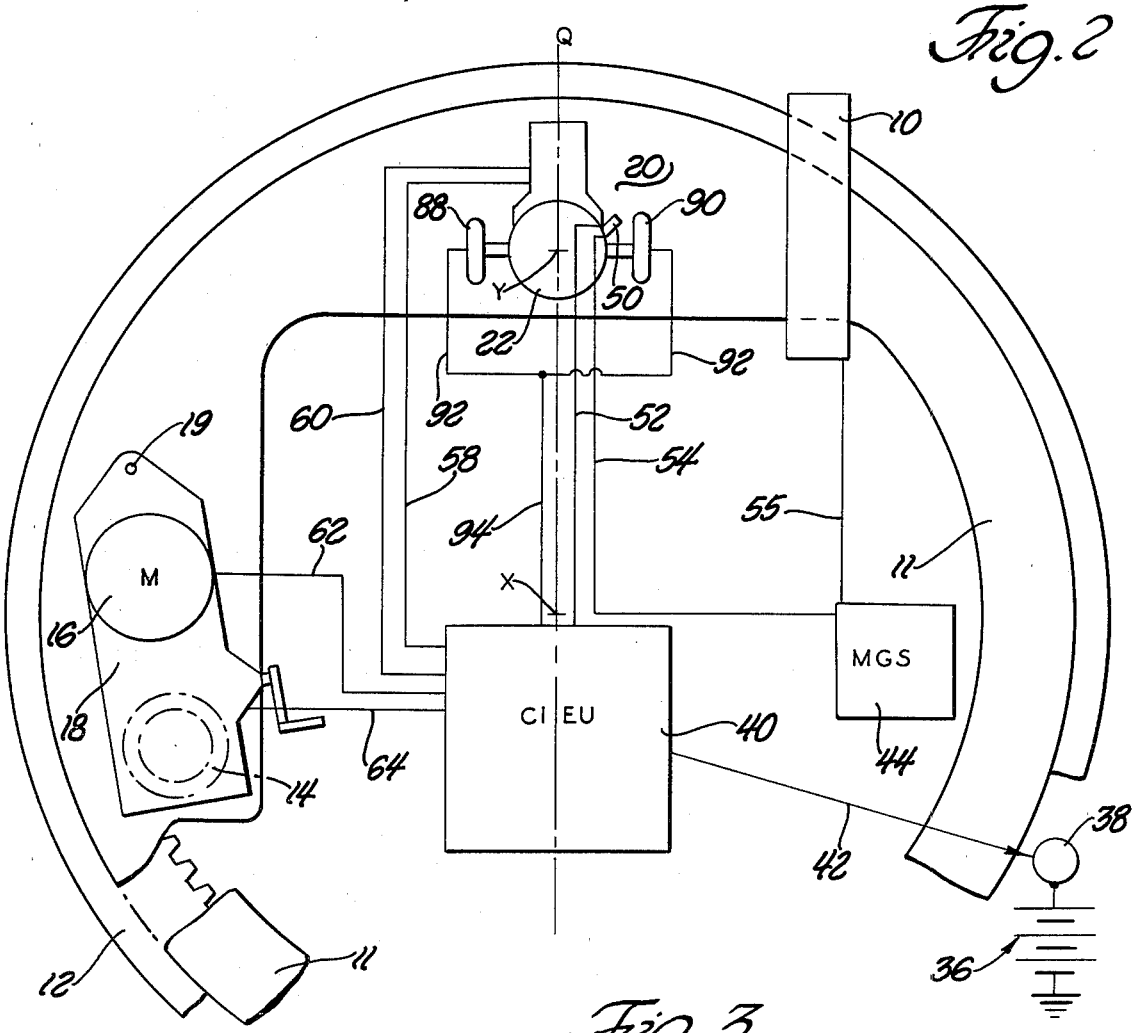
FIG. 3 is a schematic view of the TOW missile system installation and its functional relationship to the turret.

Turret 6, and everything it carries (i.e., is mounted on it), rotates about a substantially vertical axis shown at X—X in FIGS. 1 and 2 and at X in FIG. 3. Turret 6 may be conventionally mounted on a turret base plate 11 which is conventionally mounted for rotation on the hull, details of which are not shown here because the hull and turret structure are not the invention here disclosed and claimed. Secured to the hull below base late 11 is a ring gear 12 (FIG. 3), internally toothed and meshing with a pinion 14. An electric motor 16 can be connected by any suitable drive, here shown schematically at 18, to drive pinion 14. Motor 16 and pinion 14 are mounted on and rotate with turret 6; the turret drive assembly is pivotally mounted on base plate 11 at 19.

Mechanical drive 18 must be precise for accurate control during tracking; backlash in the power train must be reduced to a minimum, for example. The details thereof form no part of this invention. However, a preferred drive having the required characteristics is detailed and claimed in a copending application of Martin J. Neumeyer, Ser. No. 88,433, filed Oct. 26, 1979.

Figure 5:
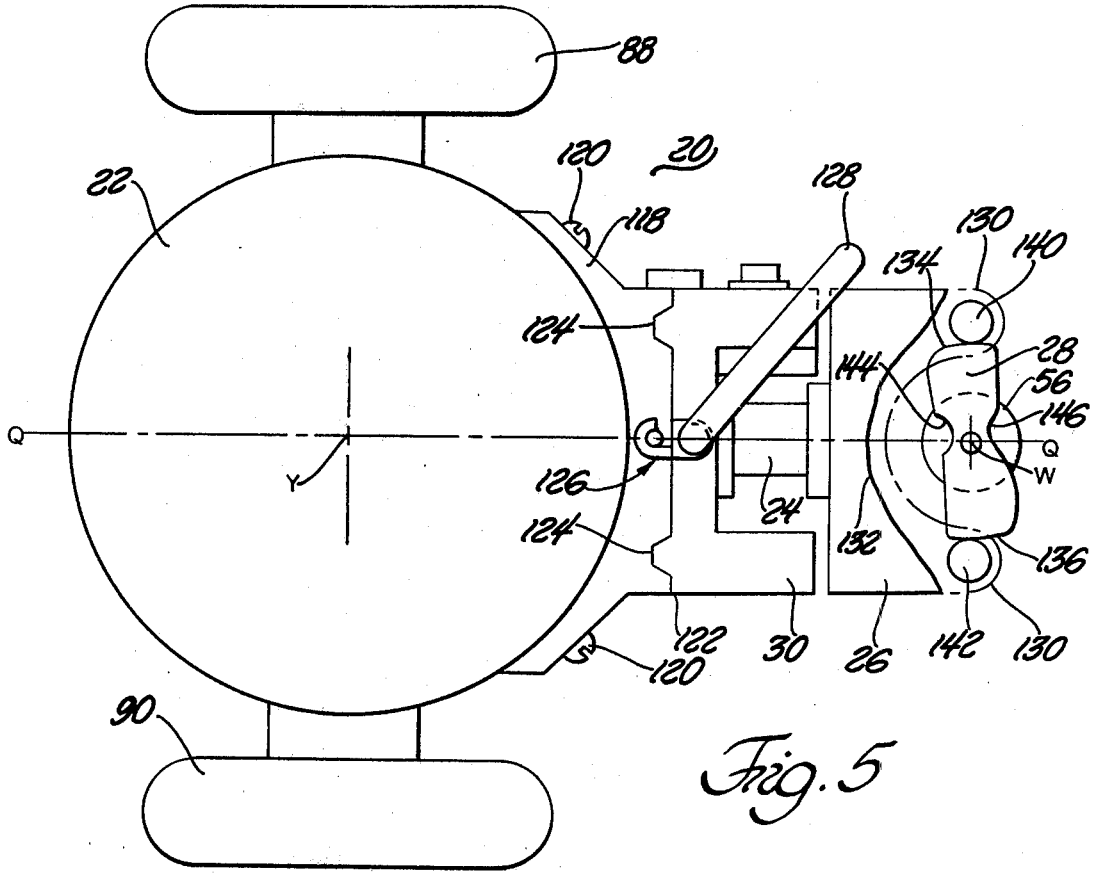
FIG. 5 shows the combined traversing unit-azimuth coupler with the cam in the coupled position.

The heart of the invention, namely the assembly 20, is comprised of a traversing unit 22, a force transducer 24, a force transfer arm 26, a butterfly cam 28, and an azimuth coupler 30 (detailed later and shown in FIGS. 4 and 5). The traversing unit portion 22 of assembly 20 is mounted on the turret to have limited rotation about a second axis shown at Y—Y in FIG. 2 and at Y in FIGS. 3, 4 and 5. Assembly 20 supports a target sighting device 32 on a horizontal pivot axis shown at Z in FIG. 2, where axis Z is substantially perpendicular to the plane of the paper. The sighting device is thus capable of following a target because of its universal joint type of support on axes Y—Y and Z in the mode wherein cam 28 is unlocked (FIG. 4); and about axes X—X and Z in the locked mode of cam 28 (FIG. 5).

To provide the gunner a more stable platform for sighting and guiding the missile after firing, provision is made to brake the turret against accidental angular displacement during wire guidance. Such provision takes the form of a brake for drive motor 16. Such brakes are very old in the art and need not be detailed here. It suffices here to note that when the brake circuit is unenergized, a conventional spring arrangement holds the brake in its "on" position (unless the manual override is in the "off" position; see the above-identified application Ser. No. 88,433 of Neumeyer, filed Oct. 26, 1979). Thus power is normally needed to release the brake.

OPERATING CIRCUITRY

The vehicle storage battery is shown at 36, of which the conventionally positive pole is wire connected through a system of slip rings shown schematically at 38 to a Control Interface Electronic Unit (CIEU) 40, by means of a conductor 42. The CIEU 40 comprises standard electronic servo control circuits, details of which are not the invention here claimed. It suffices here to note that CIEU 40 contains the analog processing, power amplification and switching logic needed to control the turret, as well as the power sources for the control system and all functions other than the TOW system itself, which has its own source of power in the Missile Guidance Set (MGS) 44.

A firing trigger switch 50 is mounted for ready access to the gunner and is electrically connected with the CIEU 40 and the MGS 44 by conductor cables 52 and 54 respectively. The MGS 44 is electrically connected with launch tube 10 by a conductor cable 55.

Butterfly cam 28 is oscillated by a rotary solenoid 56. Force transducer 24 and solenoid 56 are connected with the CIEU 40 by conductor cables 58 and 60 respectively. Cam 28's axis of rotation W is substantially parallel to turret axis X—X. Said axis W (FIGS. 5 and 6) is the same as that of the core/shaft of said rotary solenoid 56, which is mounted in a fixed position upon or relative to the turret 6.

The CIEU 40 is electrically connected with electric motor 16 and the motor brake (not shown) by conductor cables 62 and 64 respectively.

FIG. 2 shows the optical sighting device 32 in the grasp and control of a uniformed figure representing the gunner of the combat crew. The gunner grasps two handles, which contain "palm switches", 88 and 90 as he tracks the target. The palm switches incorporate normally-open electric switches and are so constructed than an effective grasp of the handle (palm switch) necessarily closes the open switch. The result is that a grasp of either handle closes the circuit to the motor brake, thus releasing the motor brake.

To accomplish such brake release, an electrical conductor cable 92 interconnects the two palm switches 88 and 90, and another cable 94 connects cable 92 electrically with the CIEU 40.

DETAILED DISCUSSION OF ASSEMBLY 20

Figure 4:
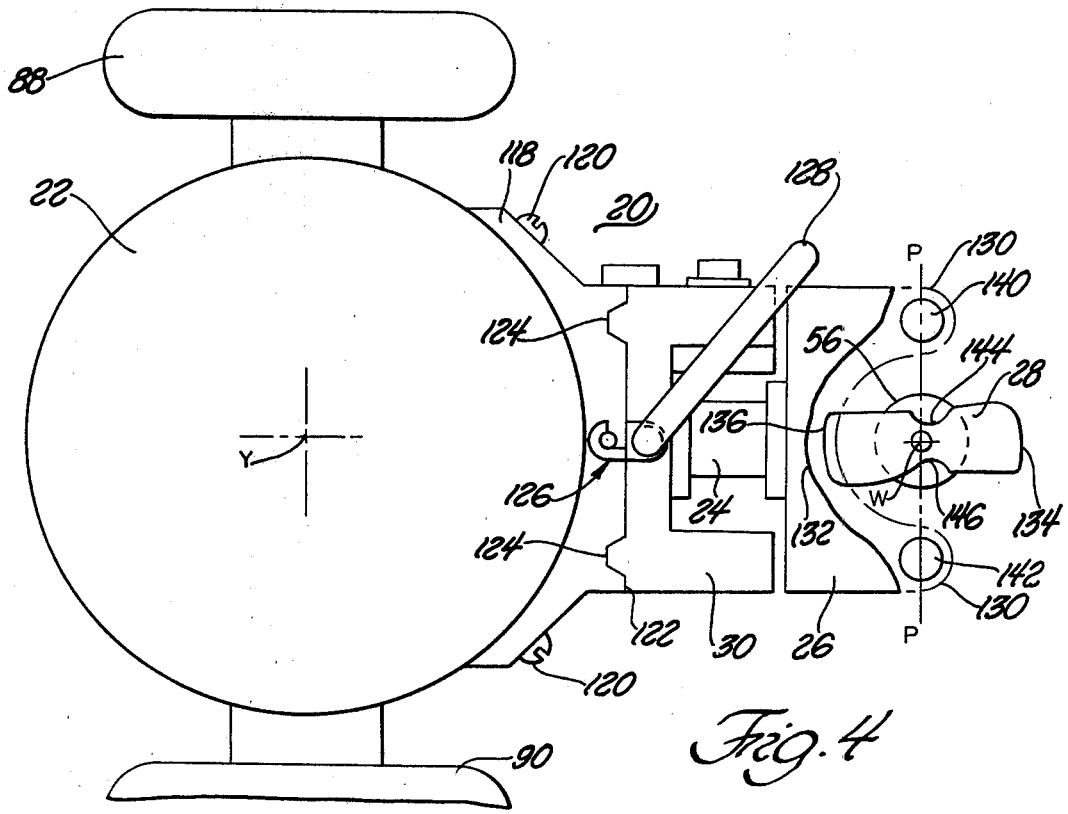
FIG. 4 shows the combined traversing unit-azimuth coupler, with the butterfly cam in the uncoupled position.

As is best seen in FIGS. 4 and 5, assembly 20 starts with traversing unit 22 which is mounted on the turret (turret base plate 11 as shown in FIG. 3) for oscillation about axis Y—Y which is parallel to axis X—X; see FIG. 2.

A mounting bracket 118 is secured to the cylindrical surface of traversing unit 22 in any conventional suitable mamner, as by threaded fasteners 120, to assure that axis of symmetry Q—Q (FIGS. 3 and 5) passes through the axis X—X (FIGS. 2 and 3) of rotation of the turret when the lock means is engaged to keep the turret slaved to target sighting device 32.

Bracket 118 is provided with a surface to interface at line 122 with a mating surface on azimuth coupler 30. The interface surface is preferably aplanar, as shown by the two deviations 124 in otherwise straight line 122, to provide a tongue-and-groove engagement at each deviation 124. Any suitable conventional latch mechanism, preferably a quick-detachable one, such as the hook-and-pin arrangement shown at 126 can be used to hold the bracket 118 and azimuth coupler 30 together. A handle 128 is shown for quick disengagement and reengagement of the latch mechanism.

Force transducer 24 is mounted on azimuth coupler 30, and force transfer arm 26 is secured to force transducer 24 and is carried thereby. Arm 26 is bifurcated, having two opposed branches 130 shown in phantom in FIGS. 4 and 5 because the arm is broken away at 132 to show details of the lock means.

A key element of the lock means is the so-called "butterfly cam" 28 referred to above and best seen in FIGS. 4 and 5. Cam 28 is an elongated member, mounted for oscillation about axis W, and provided at its opposite ends with engaging surfaces 134 and 136. Axis of oscillation W is mounted in a fixed position relative to turret 6, and elongated element 28 (the butterfly cam) is connected to be oscillated about axis W through 90° by the aforesaid rotary solenoid 56.

Spaced stops 140 and 142 are mounted in the branches 130 of force transfer arm 26, for engagement with surfaces 134 and 136 respectively of cam 28 when the cam is in the locked position of FIG. 5. To allow traversing unit 22 to oscillate through a maximum angle of sweep, cam 28 is notched as shown at 144 and 146 to receive spaced stops 140 and 142 respectively at the angular limits of oscillation of unit 22; see especially FIG. 4.

Stops 140 and 142 are conveniently the shape of cylinders, and are mounted in branches 130 with their cylinder axes substantially parallel. A plane P—P which passes through the two cylinder axes is the plane in which the cam axis W lies, also parallel to the two cylinder axes. As best seen in FIG. 4, both recesses (or notches) 144 and 146 are to the right of the line P—P defining the aforesaid plane.

In view of the preferred structure described in the foregoing paragraph, cam 28 as notched is asymmetric relative to pivot axis W. The reason for such asymmetry is to provide a stable condition of cam 28 in the locked position. With the cam in its locked position (FIG. 5), a line connecting the contact points at which surfaces 134 and 136 engage stops 140 and 142 passes through oscillation axis W. Such a condition provides maximum stability of the cam because there is no tangential force on the cam to torque the cam out of its locked position. Accordingly, rotary solenoid 56 is designed to turn cam 28 clockwise out of locking engagement (FIG. 5) into its unlocked position (FIG. 4), and counterclockwise from the FIG. 4 position into the FIG. 5 position.

OPERATION

In combat, the gunner follows (tracks) the target through sighting device 32, firmly grasping the palm switches 88 and 90. As long as either palm switch is in the gunner's grasp, the motor brake control circuit is energized and the brake is released. The turret can then be rotated by motor 16.

Turning effort applied to the handles which house the palm switches 88 and 90 is sensed through stops 140 and 142 which provide a reaction force sensed by force transducer 24 to send a signal by way of cable 58 to the CIEU 40, which processes the signal and in turn sends a signal via cable 62 to motor 16. Motor 16 responds to the signal received and turns in the direction called for by the signal and at the appropriate speed, driving the turret at the speed and in the direction called for. When the gunner ceases to exert a torque on sighting device 32, motor 16 stops and the turret also ceases to turn. However, as long as the gunner grasps either palm switch, the brake circuit remains energized and the motor brake is in its "off" position.

When the gunner pushes the trigger button 50, a circuit is completed (cables 54 and 55, and MGS 44) which results in the missile launch sequence for launch tube 10; the missile is fired and proceeds to leave the launch tube. Activation of trigger button 50 also sends a signal to the CIEU 40 (cable 52) which in turn sends a signal to the motor brake via cable 64. The CIEU brake signal which results from activation of trigger 50 passes through a built-in time delay to deenergize the motor brake circuit so as to give the missile time to leave the launch tube before the motor brake is applied. A time delay of 1.5 second is deemed sufficient in one application of the system to date.

After the missile leaves the launch tube, the motor brake is applied in response to the signal from the CIEU 40, whereupon the support for sighting device 32 becomes a fixed (relative to the vehicle) platform. When trigger button 50 is activated, the CIEU 40 also sends an unlocking signal via cable 60 to rotary cam 28, pivoting the cam clockwise from its locked position shown in FIG. 5 to its unlocked position shown in FIG. 4.

With cam 28 in its unlocked mode (FIG. 4), traversing unit 22 can be turned about its pivot axis Y—Y by the gunner as he continues to track the target. However, in the mode now in effect, the missile is guided by its own on-board guidance system responding to signals transmitted by wire from the MGS 44.

After a predetermined time delay (in this case, 18 seconds), cam 28 is pivoted counterclockwise automatically from its FIG. 4 position into its FIG. 5 position. Such resetting of the butterfly cam lock means is built into the circuitry of the CIEU 40 and is a function of the contemplated flight time of the missile from the launch tube to the target; by that "flight time", the missile will have: (1) either hit the target and thus require no more guidance; or (2) missed the target and further guidance is pointless. After the cam has been reset to once more lock traversing unit 22 against pivotal movement on axis Y—Y, the gunner again controls azimuth of the reloaded launch tube through turret rotation.

We wish it to be understood that we do not desire to be limited to the exact details of construction shown and described for obvious modifications will occur to a person skilled in the art.

We claim:

1. In a fire control system for a combat vehicle having a rotatable turret:

a. a traversing unit carried by the turret, mounted for pivoting about an axis substantially parallel to the axis of rotation of the turret, said unit adapted to carry an optical sighting device;

b. a force transducer carried by the traversing unit;

c. a force transfer arm carried by the force transducer, the arm being bifurcated to form two opposed branches;

d. a stop on each of the bifurcation branches;

e. a two-position cam having opposed engaging surfaces pivotably mounted on the turret on an axis substantially parallel to the axis of rotation of the turret and between the two stops, whereby positioning of the cam with its engaging surfaces in contact with said stops locks the traversing unit against pivoting about its axis and positioning of the cam with its engaging surfaces between the stops permits such pivoting;

f. and means to pivot the cam from one position to the other.

2. In a fire control system as set forth in claim 1, wherein the cam is an elongated element with said surfaces provided at the ends of the elongated element, and the elongated element being recessed between the surfaces to receive the stops when the cam is in its unlocked position to permit pivoting of the traversing unit about its axis.

3. In a fire control system as set forth in claim 2, wherein each of the stops is a cylindrical element, the axis of each cylinder being parallel to the traversing unit axis of rotation, and the cam disposed such that the cam axis of rotation lies in a plane passing through the two cylinder axes.

4. In a fire control system as in claim 3, and the recessed surfaces being asymmetric relative to the cam axis of rotation.

5. In a fire control system as in either of claims 1 and 2, wherein the cam pivot means is adapted to oscillate the cam between its two operating positions.

6. In a fire control system as in either of claims 3 and 4, wherein the cam pivot means is adapted to oscillate the cam between its two operating positions.

7. In a fighting vehicle having a support and a turret rotatable on the support: a fire control system comprising a. a sighting and aiming device rotatable on the turret;

b. a projectile launcher mounted on the turret;

c. means for selectively coupling and uncoupling said aiming device to and from the turret first for general slewing and rough aiming of the weapon, and secondly for permitting aiming of the projectile launcher independently of the turret;

d. said coupling means comprising a pair of elements one of which is mounted on said turret and the other is mounted on said sighting and aiming device:

(1) one of said pair of elements being stop means; and (2) the other being an engageable element adapted to be selectively engageable with said stop means; and e. wherein said engageable element is a two-position cam pivotably mounted, movable into one position for engagement with said stop means to thereby couple the aiming device and the turret, and movable into a second uncoupling position for enabling movement of said aiming device independently of said turret.

8. A fire control system as in claim 7, wherein said stop means consists of a pair of spaced projections.

9. A fire control system as in claim 7 or 8, including means activated by projectile launch to move said cam out of engagement with said stop means.

10. A fire control system as in claim 8, and wherein said pivotable cam engageable element is an elongated member having an engaging surface at each end; and means to pivot said cam between the two positions whereby the engaging surfaces contact the spaced projections for coupling of said aiming device and said turret.

* * * * *